US005988620A

United States Patent [19]

Graushar

[11] Patent Number: 5,988,620

[45] **Date of Patent: *Nov. 23, 1999**

[54] APPARATUS AND METHOD FOR PERSONALIZING PRINTED MATERIALS

[75] Inventor: William T. Graushar, Wauwatosa, Wis.

[73] Assignee: Quad/Tech, Inc., Sussex, Wis.

[ * ] Notice: This patent is subject to a terminal disclaimer.

[21] Appl. No.: 08/866,992

[22] Filed: Jun. 2, 1997

Related U.S. Application Data

[63] Continuation-in-part of application No. 08/562,258, Nov. 22, 1995, Pat. No. 5,634,633.

[51] Int. Cl.[6] ..... B65H 39/02; B42C 11/02

[52] U.S. Cl. ..... 270/1.02; 270/58.05; 412/4; 412/13; 412/19

[58] Field of Search ..... 270/58.04, 58.05, 270/52.16, 1.02; 412/3, 4, 13, 19

[56] References Cited

U.S. PATENT DOCUMENTS

| | | | |
|---|---|---|---|
| 4,022,455 | 5/1977 | Newsome et al. | 270/54 |
| 4,305,605 | 12/1981 | Vine | 281/35 |
| 4,319,948 | 3/1982 | Volkert et al. | 156/357 |
| 4,420,282 | 12/1983 | Axelrod | 412/4 |
| 4,505,467 | 3/1985 | Brocklehurst | 270/53 |
| 4,606,715 | 8/1986 | Larson | 425/110 |
| 4,851,074 | 7/1989 | Uchida | 156/541 |
| 4,971,647 | 11/1990 | Leslie | 156/249 |
| 5,013,019 | 5/1991 | Samuels | 270/1.1 |
| 5,013,022 | 5/1991 | Graushar | 270/56 |
| 5,045,148 | 9/1991 | Hoffstetter et al. | 156/567 |
| 5,061,334 | 10/1991 | Paules | 156/235 |
| 5,100,116 | 3/1992 | Graushar | 270/1.1 |
| 5,114,128 | 5/1992 | Harris, Jr. et al. | 270/11 |
| 5,144,562 | 9/1992 | Stikkelorum et al. | 364/478 |
| 5,230,501 | 7/1993 | Melton | 270/41 |
| 5,232,324 | 8/1993 | Graushar | 412/4 |
| 5,316,425 | 5/1994 | Graushar et al. | 412/19 |
| 5,413,446 | 5/1995 | Rathert et al. | 412/17 |
| 5,417,535 | 5/1995 | Andjelic et al. | 412/2 |
| 5,643,633 | 6/1997 | Grausher | 270/58.05 |

*Primary Examiner*—Hoang Nguyen
*Attorney, Agent, or Firm*—Michael Best & Friedrich LLP

[57] ABSTRACT

An apparatus and method for attaching a cover to a signature. The apparatus includes a cover applicator for securing covers to signatures, a signature supplier positioned to provide at least one signature to the cover applicator, a cover feeder positioned to feed covers in separated relation to the cover applicator, and a printer positioned between the cover feeder and the cover applicator. The printer is oriented to print onto a surface (e.g., an inner surface) of a cover fed from the cover feeder. The apparatus can further include an item feeder positioned to feed items in separated relation to the cover applicator, and an adhesive applicator positioned to deposit adhesive between the item and the cover. For example, the printer can be oriented to print on a printed area of a cover fed from the cover feeder, and the item feeder can be oriented to deposit an item onto the printed area. Preferably, the apparatus further includes an item printer positioned to print on an item fed from the item feeder.

14 Claims, 5 Drawing Sheets

APPARATUS AND METHOD FOR PERSONALIZING PRINTED MATERIALS

REFERENCE TO RELATED APPLICATIONS

This is a continuation-in-part of U.S. application Ser. No. 08/562,258, filed Nov. 22, 1995 and issued as U.S. Pat. No. 5,634,633 on Jun. 3, 1997.

TECHNICAL FIELD

The present invention generally relates to the field of producing printed materials (e.g., magazines and the like), and more particularly to the field of personalizing printed materials for targeting specific recipients of the printed materials.

BACKGROUND OF THE INVENTION

Collating and binding systems are well known in the printing industry for mass producing printed products, such as booklets, magazines, catalogues, advertising brochures and the like. Typically, one or more sharply folded and generally pre-printed blanks or signatures are sequentially fed by a number of spaced signature feeders. The signatures are delivered such that the signatures come to rest upon a collating conveyor line which travels past the signature feeders. The conveyor gathers the signatures, one on top of the other, into a book block and moves the book block to a binding station where a cover is applied.

Recently, it has become desirable to secure items to a printed product. As used herein, the term item refers to any object that is attached to a printed product by means other than by binding, and that is smaller (e.g., in surface area) than the printed product to which it is attached. For example, it may be desirable to secure a credit card, envelope, sample packet, signature or other items to a printed product. In order to accomplish this, it is known to glue the items directly to the individual signatures, one at a time, and then provide the signatures in a shingled stream to a downstream operation (e.g., a gatherer). For example, a device known as "The Attacher", sold by Ga-Vehren Engineering, can perform this function.

It can be appreciated that the transport of signatures from the attaching device to the subsequent operation can be difficult in view of the fact that the signatures have protruding items attached to them. This can result in problems associated with smooth transport of the signatures, particularly in a shingled stream. The problem is particularly evident in the case of magazine covers, which are typically fed individually from a stack by a cover feeder. Items secured to the covers tend to interfere with feeding the covers from the stack.

The printing industry has also recognized the need for flexibility in producing different versions of the same book to be mailed to users in the same geographical location, and the value of printing personalized messages (e.g. directed to a specific consumer or group of consumers) on each book. Ink jet printing is commonly used for producing such personalized messages on these types of books.

U.S. Pat. No. 5,100,116 discloses an apparatus that can print on the full page of signatures. The disclosed printing apparatus removes signatures from a stack and separates the signatures for printing. The signatures are subsequently fed to a collating conveyor where the signatures are gathered to form a book block.

SUMMARY OF THE INVENTION

The present invention is directed to an apparatus and method that prints personalized indicia onto a cover after the cover is fed from the corresponding cover feeder, and before the cover is secured to a signature or book block. The apparatus can also secure an item to the surface of the cover, or to the surface of a cover wrap. In addition, by utilizing two adhesives, the apparatus can secure items to the surface of a signature (e.g., the outside of a book block), as described below in more detail.

By virtue of the present invention, since printing personalized indicia on the covers occurs after the covers are fed from the cover feeder, the personalized covers are less prone to being attached to the wrong book block. That is, since the book block may also have personalized indicia corresponding with a particular individual, it is important for the corresponding personalized cover to be bound thereto. Furthermore, since the items are being attached after the covers are fed from the cover feeder, the items are less prone to interfere with subsequent handling of the printed product. For example, with the present invention, the covers can be fed directly to the cover applicator, thereby avoiding the necessity of re-stacking or re-imbricating the covers after the items are secured thereto. In addition, it is noted that the present invention secures the items to the covers further downstream in the process compared to other apparatuses (i.e., after the cover feeder, rather than before the cover feeder). This is beneficial in that less items are in process and, accordingly, less product will need to be scrapped in the event of a malfunction.

In one aspect, the present invention provides an apparatus for attaching a cover to a signature. The apparatus comprises a cover applicator for securing covers to signatures, a signature supplier positioned to provide at least one signature to the cover applicator, a cover feeder positioned to feed covers in separated relation to the cover applicator, and a printer positioned between the cover feeder and the cover applicator. The printer is oriented to print onto a surface (e.g., an inner surface) of a cover fed from the cover feeder.

In one embodiment, the apparatus further includes a item feeder positioned to feed items in separated relation to the cover applicator, and an adhesive applicator positioned to deposit adhesive between the item and the cover. For example, the printer can be oriented to print on a printed area of a cover fed from the cover feeder, and the item feeder can be oriented to deposit an item onto the printed area. Preferably, the apparatus further includes an item printer positioned to print on an item fed from the item feeder.

The present invention also teaches a method of attaching a cover to a signature. The method comprises the steps of providing a stack of covers, separating a cover from the stack, printing on a surface (e.g., an inner surface) of the separated cover, and securing the separated cover to at least one signature.

In one embodiment, the method further comprises the step of depositing an item onto the separated cover, and preferably the step of positioning adhesive between the item and the cover. Preferably, the printing step includes printing on a printed area of the cover, and the depositing step includes depositing the item onto the printed area. If desired, the method can further include the step of printing on the item.

DETAILED DESCRIPTION OF THE PREFERRED EMBODIMENT

Figure 1:
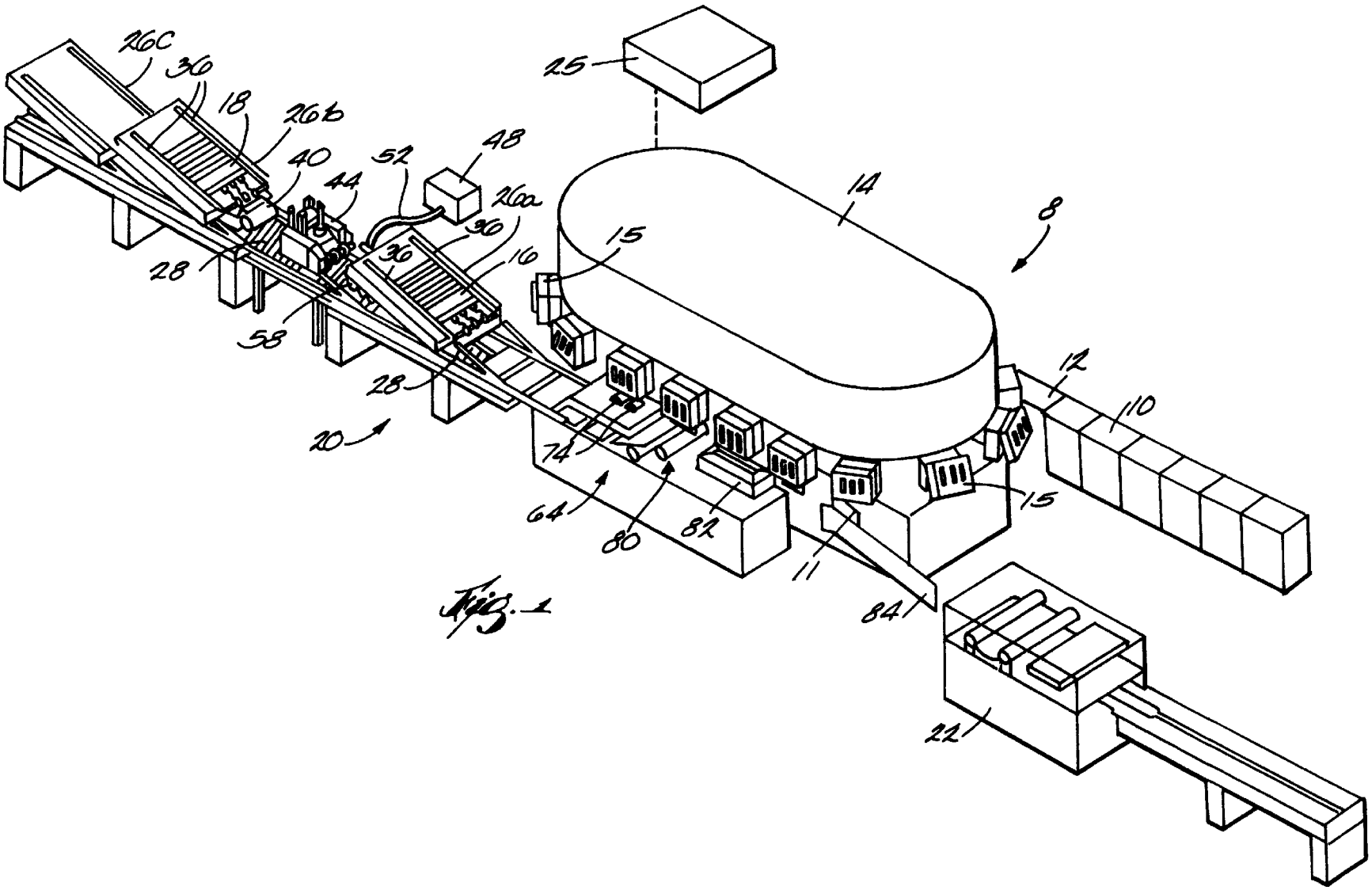
FIG. 1 is a fragmentary, perspective view of a binding system employing the present invention.

FIG. 1 illustrates a binding system 8 that is employed to produce various magazines, catalogues, brochures, periodicals, or other printed products containing items secured to a cover (e.g., cover or cover wrap). The illustrated system 8 includes a gatherer 10 that gathers signatures into a book block 11, and provides the book block 11 to a collating conveyor 12. The collating conveyor 12 transports the book blocks 11 to a perfect binder 14, where the book blocks 11 are transferred to clamps 15 and controllably conveyed around the perfect binder 14. At the perfect binder 14, the book blocks 11 are held along one longitudinal edge so that their respective folds, or backbones, are directed downwardly. In this orientation, each book block 11 is initially trimmed along its held longitudinal edge, and then roughened along its backbone. Following these preparations, a cover 16 and cover wrap 18 are applied to the book blocks 11 by a cover applicator 20. The covered book blocks are then conveyed to a trimmer 22 where edges are further trimmed as desired.

Thereafter, assembled books are transferred to a labeling station (not shown) where a mailing label is printed or otherwise applied, and may be conveyed to a tabbing machine (not shown) at which one or more closure tabs are applied to hold books closed during mailing. In some instances, removable inserts, which are blown in or otherwise inserted between the pages of books before the books reach tabbing station, are also maintained in place by using the closure tabs. Strapping machines (not shown) may also be provided after the labeling station and the tabbing machine to place retaining straps around the books. The finished books may then be routed to a wrapping machine (not shown) which bundles and readies them for mail or other distribution. A conventional controller 25 is preferably operatively connected to all of the foregoing major components and provides control signals thereto.

The gatherer 10, collating conveyor 12, perfect binder 14, trimmer 22, labeling station, tabbing machine, wrapping machine and strapping machine are of conventional construction and do not require a detailed discussion.

Figure 2:
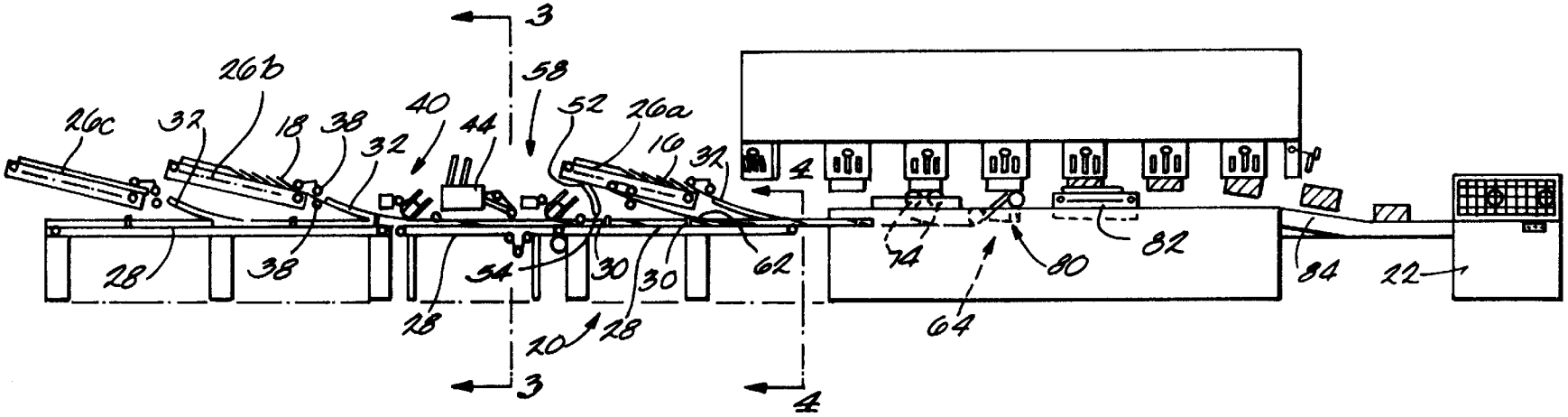
FIG. 2 is a side elevation view of the system shown in FIG. 1.

Referring to FIGS. 1 and 2, the illustrated cover applicator 20 includes a series of cover feeders 26*a,b,c*, each of which is disposed at an angular position by braces (not shown) with respect to the generally flat surface of a set of endless belts 28. It should be appreciated that any number of cover feeders could be used. The endless belts 28 include registration lugs 30 and are driven in a conventional manner to provide a moving surface for transporting the covers 16 and cover wraps 18 to the perfect binder 14. A series of channels 32 facilitate communication between each cover feeder 26 and the belts 28.

In the drawings, three cover feeders 26*a,b,c* are shown in series to allow for as many as three different book covers to be applied, but it should be understood that any number of cover feeders may be employed contingent upon the type of covers offered. In the described embodiment, a first cover feeder 26*a* feeds a cover 16, and a second cover feeder 26*b* feeds a cover wrap 18. A third cover feeder 26*c* is not used in the illustrated embodiment. The two cover feeders 26*a,b* hold an imbricated supply of unfolded covers and cover wraps, respectively. The covers and cover wraps are aligned in the cover feeders 26 by registration guides 36 (FIG. 1) and controllably delivered to the endless belts 28. The illustrated cover feeders 26 are part of a Multiple Cover Deck available from A. M. Sheridan.

As noted above, the second cover feeder 26*b* preferably feeds a cover wrap 18. Controller 25 actuates the second cover feeder 26*b* to move an open or unfolded cover wrap 18 between a pair of driven feed rollers 38 (FIG. 2) for delivery to the endless belts 28. A first pattern gluer 40 is positioned adjacent to the outfeed of the first cover feeder 26*b*. The first pattern gluer 40 applies a predetermined pattern of temporary adhesive 42 (FIG. 3) to the top (i.e., inside surface) of the cover wrap 18. The temporary adhesive 42 is positioned at the location where the subsequently-applied card is desired. As used herein, the term temporary adhesive means any substance that holds the card in place until the card can be secured to something else by another, more permanent adhesive. The temporary adhesive 42 could include any appropriate medium to temporarily hold the card in place, such as a fugitive adhesive (e.g., a crystallizing adhesive) or even moisture. In the illustrated embodiment, the temporary adhesive is a fugitive adhesive, available from National Starch and Chemical Company and the first pattern gluer 40 comprises a Ga-Vehren Pattern Gluer, available from Ga-Vehren Engineering, St. Louis, Mo. Other temporary adhesives or pattern gluers could also be used.

Figure 3:
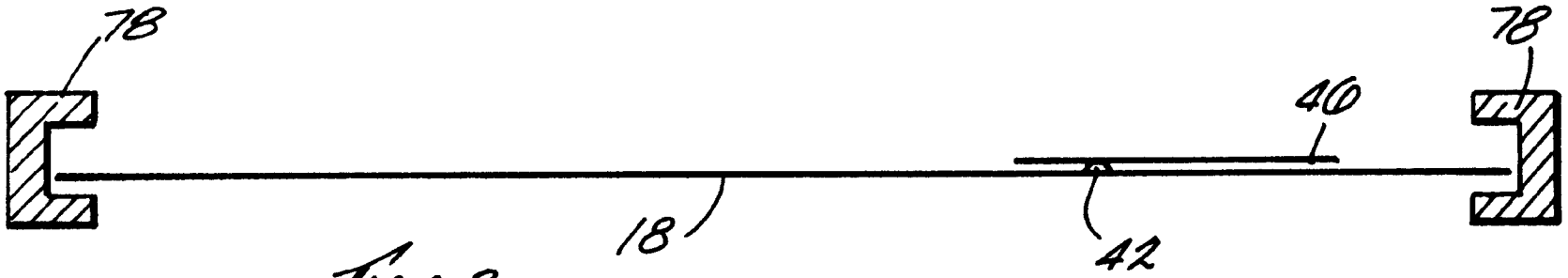
FIG. 3 is a section view taken along line 3—3 in FIG. 2.

A item feeder 44 delivers items, one at a time, on top of the previously-positioned cover wrap 18. The separate components are timed such that the item feeder 44 delivers the items on the temporary adhesive 42, thereby temporarily maintaining the item in contact with the cover wraps 18. In the described embodiment, the item is a card 46. FIG. 3 illustrates a cross section of the card 46 temporarily secured to the cover wrap 18. It should be appreciated that items other than cards could be attached to a printed product utilizing the principles of the present invention. In the illustrated embodiment, the item feeder comprises a product called "The Attacher" available from Ga-Vehren Engineering in St. Louis, Mo.

An adhesive dispenser 48 is positioned downstream of the cover wrap feeder 26*b*. Such dispensers are generally known in the art, such as is available from Nordson Corporation of Duluth, Ga. The adhesive dispenser 48 selectively meters a releasable adhesive 50 (FIG. 4) through a delivery hose 52 to a dispensing nozzle 54 mounted beneath the first cover feeder 26*a*. The adhesive dispenser 48 applies a releasable adhesive to the cover wrap 18 along the binding (i.e., where the binding of the magazine and cover will be positioned). The releasable adhesive 50 is designed to adhere to the cover 16, yet be removable therefrom without damaging the cover 16. The releasable adhesive can comprise a pressure sensitive adhesive available from the National Starch and Chemical Company under product numbers 70-3704 and 34-2602.

A second pattern gluer 58 applies a pattern of a stronger, more permanent adhesive 60 to the top surface of the card 46. The stronger adhesive 60 is stronger and more permanent than the above-described temporary adhesive 42. However, similar to the releasable adhesive 50, the stronger adhesive 60 of the described embodiment is removable from the cover 16 without damaging the cover 16. The second pattern gluer can be identical to the first pattern gluer, and the stronger adhesive 60 can be the same as the releasable adhesive 50.

Figure 4:
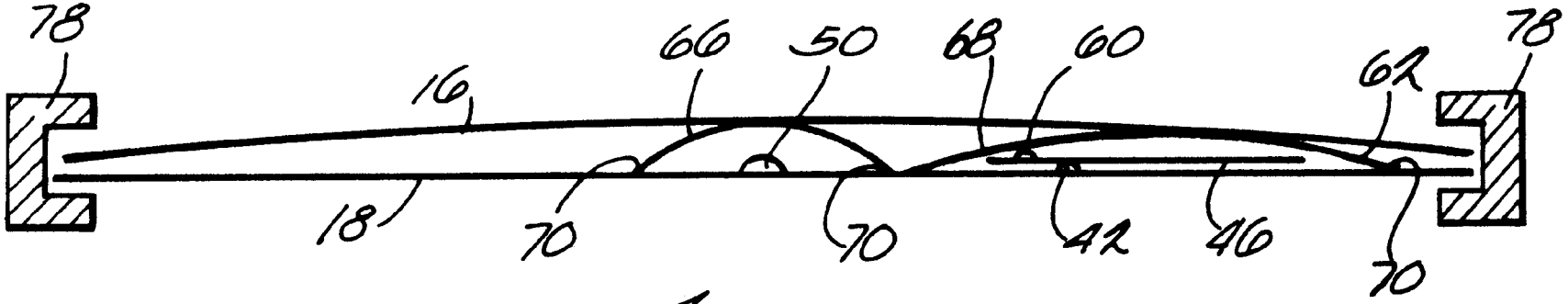
FIG. 4 is a section view taken along line 4—4 in FIG. 2.

An elongated spacer bar 62 is supported above the endless belts 28. The spacer bar 62 extends from beneath the first cover feeder 26*a* and terminates downstream at an adhesive station 64. As seen in FIG. 4, spacer bar 62 has first and second concave portion 66, 68 engageable with the bottom of cover 16 and bottom edges 70 in contact with the top of cover wrap 18. The first concave portion 66 separates the releasable adhesive 50 on the cover wrap 18 from the subsequently-applied cover 16 until the cover 16 and cover wrap 18 are fully registered with the registration lugs 30 on the belts 28. The second concave portion 68 separates the stronger adhesive 60 on the card 46 from the subsequently-applied cover 16 until registration has occurred.

The first cover feeder 26*a* is the same as the second cover feeder 26*b*, except that the first cover feeder 26*a* feeds covers 16 as opposed to cover wraps 18. The first cover feeder 26*a* deposits a cover 16 over the spacer bar 62 and over each previously-deposited cover wrap 18 and associated card 46. As noted above, the spacer bar 62 maintains the cover 16 separated from the releasable adhesive 50 and stronger adhesive 60 until the cover is properly registered against the registration lugs 30 on the belts 28, as is shown in FIG. 4.

In operation, as book blocks 11 are conveyed by perfect binder 14, controller 25 transmits appropriate signals to actuate cover feeders 26*a,b* and item feeder 44 to feed cover wraps 18, covers 16 and cards 46 to the endless belts 28. First, cover feeder 26*b* delivers a cover wrap 18 to the corresponding channel 32 and subsequently to the endless belts 28, where the cover wrap 18 is engaged by the registration lugs 30. After registration has been achieved, the first pattern gluer 40 applies the temporary adhesive 42 to the top surface of the cover wrap 18 in the location where the card will be positioned.

The cover wrap 18 is subsequently transported by the endless belts to a position directly under the item feeder 44, where a card 46 is deposited over the temporary adhesive 42 on the cover wrap 18. The temporary adhesive 42 holds the bottom surface of the card 46 in position on the cover wrap 18 until the card is secured to the cover, as described below. The second pattern gluer 58 subsequently applies a stronger adhesive 60 to the top surface of the card 46, and the adhesive dispenser 48 applies a releasable adhesive 50 along the center binding of the cover wrap 18, as shown in FIG. 3. The stronger adhesive 60 and the releasable adhesive 60 are designed to allow the card and the cover wrap, respectively, to be easily removed from the cover 16 without damaging the cover 16.

The cover wrap 18 and card 46 are subsequently transported under the spacer bar 62 to the first cover feeder 26*a*, where a cover 16 is deposited over the spacer bar 62, the card 46 and the cover wrap 18. As seen best in FIG. 4, spacer bar 60 serves to temporarily separate the cover 16 from the releasable adhesive 50 and the stronger adhesive 60. Such separate should occur until proper registration of the cover 16 against the registration lugs 30 and guide rails has been achieved.

Subsequent processing of the printed product is generally known and is provided below only as general background. Referring now to FIG. 2, the cover 16 and cover wrap 18 are instantly merged together as they reach the end of spacer bar 62 at adhesive station 64, and are joined together in substantially flattened registration by means of releasable adhesive 50. Simultaneously, rollers 74 at the adhesive station 64 apply a second strip of glue to the backbone of the book block 11 traveling in each clamp 15. The glue applied by the rollers 74 is markedly different from the releasable adhesive 50 in that it exhibits a much greater bonding strength which is intended to provide substantially permanent adhesion of cover 16 to the book block. Such adhesive is commercially sold as hot melt 34-1123 by National Starch and Chemical Company.

Immediately after the second strip of glue is applied, the registration lugs 30 of the endless belt 28 direct the cover 16 and cover wrap 18 past lateral guide rails 78 to an applier drum 80 where the cover 16 and cover wrap 18 are joined to the back of a book block 11 held in the moving clamp 15. Thereafter, a conventional cover breaker 82 is employed to fold the cover 16 and cover wrap 18 about the book block 11. The finished book is then conveyed by the clamp 15 and released into a chute 84 which serially feeds the finished book to the trimmer 22, labeling station, tabbing machine, strapping machine and wrapping machines, as desired.

As noted above, each finished book is provided with a cover 16 and a cover wrap 18. In the system described above, the cover wrap 18 is preferably kraft paper and serves as a protective wrapper for the cover 16 and the remainder of the book. Alternatively, the cover wrap 18 could be another cover. The cover 16 may be blank or pre-printed with customized or common information as desired on its outside and inside surfaces. Because of the peelable nature of the releasable adhesive 50, the cover wrap 18 is intended to be substantially separable and disposable as desired from the cover 16 which is bound more strongly to the book. The kraft paper used for the cover wrap 18 is environmentally preferable to other cover materials because of its normal decomposition ability. The cover 16 is usually the actual cover of the book and may display artwork, photography, and other information worthy of protection. The card 46 is also peelable from the cover 16 by virtue of the releasable stronger adhesive 60.

Figure 6:
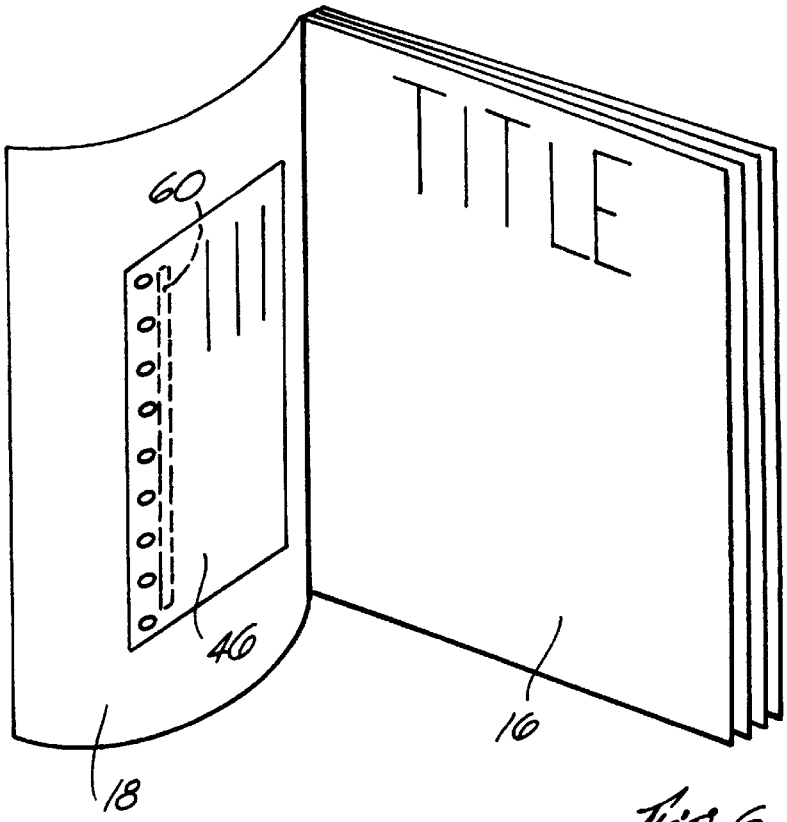
FIG. 6 is an illustration of another printed product produced by the apparatus illustrated in FIG. 1.
Figure 5:
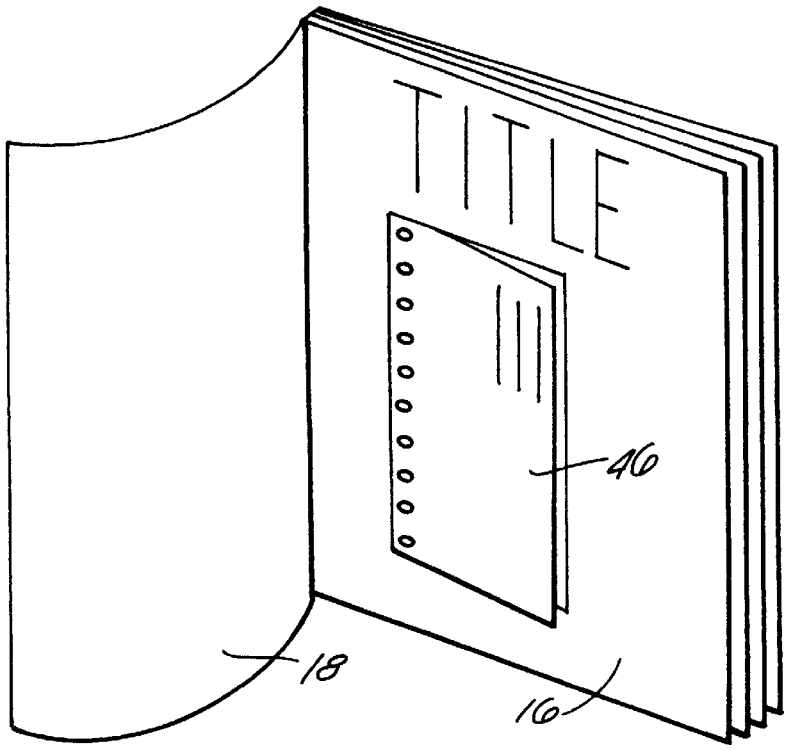
FIG. 5 is an illustration of a final printed product produced by the apparatus illustrated in FIG. 1.

The illustrated embodiment results in a printed product having a card secured to the outside surface of the cover, as shown in FIG. 5. However, it should be appreciated that the principles of the present invention could also be used to attach the card 46 to various other locations. For example, the card 46 could be secured to the inside of the cover wrap 18 by using the stronger adhesive 60 with the first pattern gluer, thereby resulting in a product as shown in FIG. 6. It is also possible to attach the card 46 to the inside of the cover 16 by positioning the pattern gluer after the first cover feeder, followed by the item feeder. In the latter two situations, there would be no need for a temporary adhesive to temporarily secure the card to a surface in preparation for bonding to a subsequently-deposited cover. The card 46 could also be secured to the outside of the book block by following the first cover feeder with a pattern gluer that applies a temporary adhesive, a item feeder that deposits a card 46 onto the temporary adhesive, and a pattern gluer that applies a stronger adhesive to the card 46. It is also possible to attach the card to the outside of the cover wrap by temporarily securing the card to the endless belt, followed by the application of stronger adhesive to the card and positioning of the cover wrap over the stronger adhesive.

In an alternative embodiment, the endless belts 28 of FIGS. 1 and 2 comprise vacuum belts that can maintain the position of an item positioned thereon. Using such a system, the item can be placed onto the belts before the cover, and adhesive can be placed between the item and the subsequently-applied cover. The result is a printed product that has an item secured to the outside surface of the cover.

Figure 7:
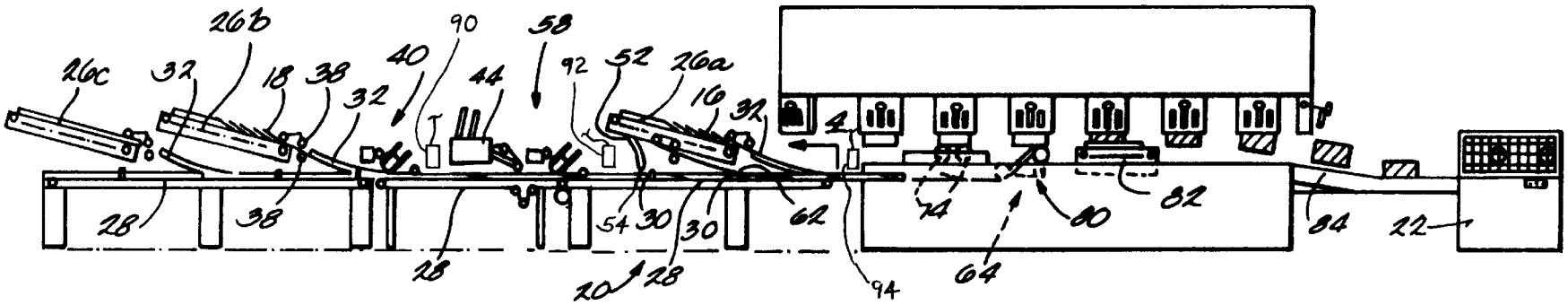
FIG. 7 is a side elevation view of an alternative embodiment of the present invention.

FIG. 7 illustrates an alternative embodiment of the present invention wherein printers in the form of three ink jet printers 90,92,94 are provided so that personalized indicia can be provided on the covers or on the item. Such personalized indicia can, for example, be geographically or individually related to the recipient of the printed product.

The first printer 90 (a cover printer) is positioned above the endless belts 28 and between the second cover feeder 26*b* (which feeds cover wraps 18) and the item feeder 44. The first printer 90 is designed to have the ability to print onto the inside surface of the cover wrap 18. Since this printing operation is performed before the item (e.g., card 46) is deposited, the printing can be position at the location where the card will be deposited. That is, the card can be deposited onto the printed indicia, thereby hiding the printed indicia until the card is removed. If desired, a printer can also be positioned below the endless belts 28 to allow printing on the outside surface of the cover wrap 18.

The second printer 92 (an item printer) is positioned above the endless belts 28 and between the item feeder 44 and the first cover feeder 26*a* (which feeds covers 16). The second printer 92 is designed to have the ability to print onto the upper surface of the item (e.g., card 46).

The third printer 94 (a cover printer) is positioned above the endless belts 28 and between the first cover feeder 26*a* (which feeds covers 16) and the adhesive station 64. The third printer 92 is designed to have the ability to print onto the inner surface of the cover.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. For example, the illustrated apparatus could apply two covers instead of a cover and a cover wrap. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An apparatus for attaching a cover to a signature, comprising:

a cover applicator for gluing covers to signatures;

a signature supplier positioned to provide at least one signature to said cover applicator;

a cover feeder positioned to feed covers onto a conveyor and in separated relation to said cover applicator; and a printer positioned between said cover feeder and said cover applicator, said printer being oriented to print onto an inner surface of a cover fed from said cover feeder prior to when the cover is glued to the at least one signature.

2. An apparatus as claimed in claim 1, further comprising:

an item feeder positioned to feed items in separated relation to said cover applicator; and an adhesive applicator positioned to deposit adhesive between the item and the cover prior to when the cover is glued to the at least one signature.

3. An apparatus as claimed in claim 2, wherein said printer is oriented to print on a printed area of a cover fed from said cover feeder, and wherein said item feeder is oriented to deposit an item onto the printed area.

4. An apparatus as claimed in claim 2, further comprising an item printer positioned between said item feeder and said cover applicator, said item printer being positioned to print on an item fed from said item feeder.

5. An apparatus as claimed in claim 1, wherein said cover feeder comprises a first cover feeder that feeds outer covers, and wherein said apparatus further comprises a second cover feeder positioned to feed inner covers in separated relation to said cover applicator.

6. An apparatus as claimed in claim 5, further comprising a second printer positioned between said second cover feeder and said cover applicator, said second printer being oriented to print onto a surface of a cover fed from said second cover feeder.

7. An apparatus as claimed in claim 6, wherein said second printer is oriented to print onto an inner surface of a cover fed from said second cover feeder.

8. A method of attaching a cover to a signature, comprising the steps of:

providing a stack of covers;

separating a cover from the stack;

next printing on an inner surface of the separated cover;

depositing an item onto the separated cover;

positioning adhesive between the item and the cover; and subsequently securing the separated cover to at least one signature.

9. A method as claimed in claim 8, wherein said printing step includes printing on a printed area of the cover, and wherein said depositing step includes depositing the item onto the printed area.

10. A method as claimed in claim 8, further comprising the step of printing on the item.

11. A method as claimed in claim 8, wherein said separating step includes separating a first cover from the stack, and wherein said method further comprises the steps of:

providing a second stack of covers;

separating a second cover from the second stack; and securing the separated second cover to the at least one signature.

12. A method as claimed in claim 11, further comprising the step of printing on the separated second cover.

13. A method as claimed in claim 12, wherein said step of printing on the separated second cover includes printing on an inner surface of the second cover.

14. A method of attaching a cover to a signature, comprising the steps of:

providing a first stack of covers;

separating a first cover from the first stack of covers;

printing on an inner surface of the separated first cover;

subsequently securing the separated first cover to at least one signature, providing a second stack of covers;

separating a second cover from the second stack of covers;

printing on an inner surface of the separated second cover; and subsequently securing the separated second cover to the separated first cover.

* * * * *